US008507781B2

(12) United States Patent
Lupini et al.

(10) Patent No.: US 8,507,781 B2
(45) Date of Patent: Aug. 13, 2013

(54) RHYTHM RECOGNITION FROM AN AUDIO SIGNAL

(75) Inventors: Peter R. Lupini, Victoria (CA); Glen A. Rutledge, Brentwood Bay (CA); William Norman Campbell, Delta (CA)

(73) Assignee: Harman International Industries Canada Limited, Victoria (CA)

( * ) Notice: Subject to any disclaimer, the term of this patent is extended or adjusted under 35 U.S.C. 154(b) by 332 days.

(21) Appl. No.: 12/797,263

(22) Filed: Jun. 9, 2010

(65) Prior Publication Data

US 2010/0313739 A1 Dec. 16, 2010

Related U.S. Application Data

(60) Provisional application No. 61/186,351, filed on Jun. 11, 2009.

(51) Int. Cl.
*G10H 7/00* (2006.01)

(52) U.S. Cl.
USPC ..... 84/611; 84/635; 84/651; 84/667

(58) Field of Classification Search
USPC ..... 84/611, 635, 651, 667
See application file for complete search history.

(56) References Cited

U.S. PATENT DOCUMENTS

| | | | | |
|---|---|---|---|---|
| 4,688,464 | A | 8/1987 | Gibson et al. | |
| 5,301,259 | A | 4/1994 | Gibson et al. | |
| 5,440,756 | A | 8/1995 | Larson | |
| 5,486,646 | A * | 1/1996 | Yamashita et al. | 84/635 |
| 5,636,128 | A * | 6/1997 | Sugimoto et al. | 702/70 |
| 5,712,437 | A | 1/1998 | Kageyama | |
| 6,057,502 | A | 5/2000 | Fujishima | |
| 6,140,568 | A | 10/2000 | Kohler | |
| 6,486,390 | B2 * | 11/2002 | Aoki et al. | 84/611 |
| 6,639,141 | B2 * | 10/2003 | Kay | 84/609 |
| 6,812,394 | B2 * | 11/2004 | Weissflog | 84/667 |
| 7,132,595 | B2 * | 11/2006 | Lu et al. | 84/612 |
| 7,148,415 | B2 * | 12/2006 | Lengeling et al. | 84/611 |
| 7,183,479 | B2 * | 2/2007 | Lu et al. | 84/612 |
| 7,193,148 | B2 * | 3/2007 | Cremer et al. | 84/635 |
| 7,250,566 | B2 * | 7/2007 | Lengeling et al. | 84/611 |
| 7,273,978 | B2 * | 9/2007 | Uhle | 84/609 |
| 7,342,166 | B2 * | 3/2008 | Kay | 84/609 |
| 7,342,167 | B2 * | 3/2008 | Cremer et al. | 84/611 |
| 7,645,929 | B2 * | 1/2010 | Chang et al. | 84/612 |
| 7,996,212 | B2 * | 8/2011 | Klefenz | 704/200 |
| 2001/0020412 | A1 * | 9/2001 | Aoki et al. | 84/611 |
| 2001/0020837 | A1 * | 9/2001 | Yamashita et al. | 318/567 |

(Continued)

OTHER PUBLICATIONS

Brian Thomson, "Looper's Delight Review of Korg DL8000R," http://www.loopers-delight.com/tools/korgDL8000R/DL8000R_Review1.html, (Oct. 21, 1999).

*Primary Examiner* — David S. Warren
(74) *Attorney, Agent, or Firm* — Klarquist Sparkman, LLP

(57) ABSTRACT

A guitar delay engine such as a multi-tap delay pedal or other rhythm engine such as a vocal multi-tap delay pedal, a drum machine, or any other device that requires setting a rhythmic pattern (i.e. level and timing information) for operation is provided. In a guitar delay device, the guitarist can hold down a foot pedal, play a rhythmic pattern on their guitar, and then release the foot pedal and have the rhythmic pattern just played emulated in the delay pattern on the device.

29 Claims, 8 Drawing Sheets

(56) References Cited

U.S. PATENT DOCUMENTS

| | | | | |
|---|---|---|---|---|
| 2002/0017188 | A1* | 2/2002 | Aoki | 84/611 |
| 2002/0152877 | A1* | 10/2002 | Kay | 84/609 |
| 2003/0024375 | A1 | 2/2003 | Sitrick | |
| 2003/0100967 | A1* | 5/2003 | Ogasawara | 700/94 |
| 2003/0221544 | A1* | 12/2003 | Weissflog | 84/667 |
| 2004/0008104 | A1* | 1/2004 | Endsley et al. | 340/407.1 |
| 2004/0112203 | A1 | 6/2004 | Ueki et al. | |
| 2005/0204904 | A1* | 9/2005 | Lengeling et al. | 84/668 |
| 2005/0211072 | A1* | 9/2005 | Lu et al. | 84/612 |
| 2006/0048634 | A1* | 3/2006 | Lu et al. | 84/612 |
| 2006/0060067 | A1* | 3/2006 | Lu et al. | 84/612 |
| 2006/0075886 | A1* | 4/2006 | Cremer et al. | 84/635 |
| 2006/0272485 | A1* | 12/2006 | Lengeling et al. | 84/611 |
| 2007/0074620 | A1* | 4/2007 | Kay | 84/619 |
| 2007/0199430 | A1* | 8/2007 | Cremer et al. | 84/611 |
| 2008/0156177 | A1* | 7/2008 | Iketani et al. | 84/609 |
| 2008/0276793 | A1* | 11/2008 | Yamashita et al. | 84/611 |
| 2009/0312819 | A1* | 12/2009 | Klefenz et al. | 607/57 |
| 2010/0191733 | A1* | 7/2010 | Park et al. | 707/737 |
| 2010/0204992 | A1* | 8/2010 | Schlosser | 704/246 |
| 2010/0313739 | A1* | 12/2010 | Lupini et al. | 84/611 |
| 2012/0192701 | A1* | 8/2012 | Watanabe et al. | 84/622 |

* cited by examiner

RHYTHM RECOGNITION FROM AN AUDIO SIGNAL

CROSS-REFERENCE TO RELATED APPLICATIONS

This application claims the benefit of U.S. Provisional Application 61/186,351, filed Jun. 11, 2009 which is incorporated herein by reference.

FIELD

The disclosure pertains to special effects devices for musical instruments. More particularly, the disclosure pertains to special effects devices producing a rhythmic effect from an electrical signal produced by a musical instrument with an electrical output, such as an electric guitar, or by an acoustic instrument or voice where the acoustic signal is transformed into an electrical signal with a microphone.

BACKGROUND

There are many effects devices currently available in the market that create rhythmic effects based on the input signal. The most common device in this category is the delay effect, which replays the input signal, with or without further processing, after a period of time and at a specified volume. The first delay effects were created using magnetic tape recorders and used the length of the tape loop and position of the tape heads to affect the type of delay sound that was created. Eventually, delay effects were created using analog bucket brigade delays, and finally with digital electronics. While the earliest tape-based delays were difficult to reconfigure without significant effort, the use of digital signal processors to create delays has led to delay effects processors with many parameters that can be manually adjusted to create the desired sound. For example, in some delay processors, many copies of the original input signal can be created and played back at various delay times by using more than one delay sub-system. Setting up the time and level parameters for all these delay sub-systems can be extremely complex and time-consuming. There exist some delay processors that can set a single time (tempo) by detecting the beat of an input signal (such as a guitar strum); however, these processors cannot set complex rhythms using this method.

SUMMARY

In some examples, rhythmic pattern recognition systems are provided that automatically set up timing and level information corresponding to a specific rhythm pattern by analyzing an input signal from a musical instrument, such as, for example, an electric guitar. In this way, a musician does not need to program the rhythm by setting the individual delay times and levels of each beat of a complex rhythm. Instead, the musician can simply play one or more repetitions of the rhythm pattern into the system and the corresponding delay times and levels required to recreate the rhythm will be set automatically.

In some examples, methods for determining rhythms include receiving a digital audio signal from a musical instrument and analyzing the received digital audio signal to detect events in the digital audio signal. Events are selected from the detected events based on one or more associated event scores, and a rhythmic pattern is extracted based on the selected events. Typically the rhythmic pattern is communicated to a musical device that is configured to produce a corresponding rhythm audio signal based on the rhythmic pattern. Typically, the rhythmic pattern is communicated to a delay effect processor, a drum machine, or a sequencer.

In some examples, the extracted rhythmic pattern includes a pattern period, beat time locations within the rhythmic pattern, and beat levels. In some embodiments, events are detected based on energy in the digital audio signal in at least one frequency band. In some examples, events are detected by estimating an energy envelope of the received digital audio signal in one or more frequency bands and estimating a derivative of the energy envelope in one or more frequency bands. At least two peaks are identified in the derivative, and the at least two peaks are associated with corresponding events, wherein timing information is extracted based on times associated with the peaks. According to some embodiments, an event time and level are established by searching forward in the energy envelope from at least one derivative peak. In additional examples, event detection includes scoring events based on at least one of a derivative peak level and an envelope peak level, and pruning events with scores less than a minimum allowable score. In further representative examples, the rhythmic pattern is extracted by locating at least one pattern period repetition.

In some representative methods, the repeating pattern is located by grouping events into candidate repeating periods, matching events between the repeating periods, establishing a cost for each set of matched events based on a temporal distance between the matching events, increasing the cost for each set of matched events based on a number of events that are unmatched between the repeating periods, determining overall costs based on the established costs and the increased costs, and selecting at least one repeating pattern based on the determined costs. In some examples, the pattern analyzer uses dynamic programming to search for the period associated with optimal event matching. In additional examples, the beat locations and levels of the rhythmic pattern are based on the event locations and levels extracted based on the rhythm pattern period. The received audio signal can be produced by a stringed instrument such as guitar, or other musical instruments.

Computer readable storage medium are provided having computer-executable instructions for methods that include analyzing a received digital audio signal to detect events in the digital audio signal, selecting events from the detected events based on scores associated with the events, and extracting a rhythmic pattern based on the selected events. In some examples, the method further comprises communicating the rhythmic pattern or storing the rhythmic pattern in a memory.

Apparatus comprise an input configured to receive a digital audio signal from a musical instrument and a processor that is configured to analyze the received digital audio signal to detect events in the digital audio signal, select events from the detected events based on scores associated with the events, and extract a rhythmic pattern based on the selected events. An output is configured to deliver the rhythmic pattern. In some examples, the processor is configured to search for a repeating pattern by grouping events into candidate repeating periods, matching events between the repeating periods, establishing a cost for each set of matched events based on a temporal distance between the matching events, increasing the cost for each set of matched events based on a number of events that are unmatched between the repeating periods, determining overall costs based on the established costs and the increased costs, and selecting at least one repeating pattern based on the determined costs. In other examples, the processor is configured to detect events by estimating an energy envelope of the received digital audio signal in one or more frequency bands, estimating a derivative of the energy envelope in one or more frequency bands, identifying at least two peaks in the derivative, and associating the at least two peaks with corresponding events, wherein timing information is extracted based on times associated with the peaks.

The foregoing and other objects, features, and advantages of the technology will become more apparent from the following detailed description, which proceeds with reference to the accompanying figures.

DETAILED DESCRIPTION

Figure 1:
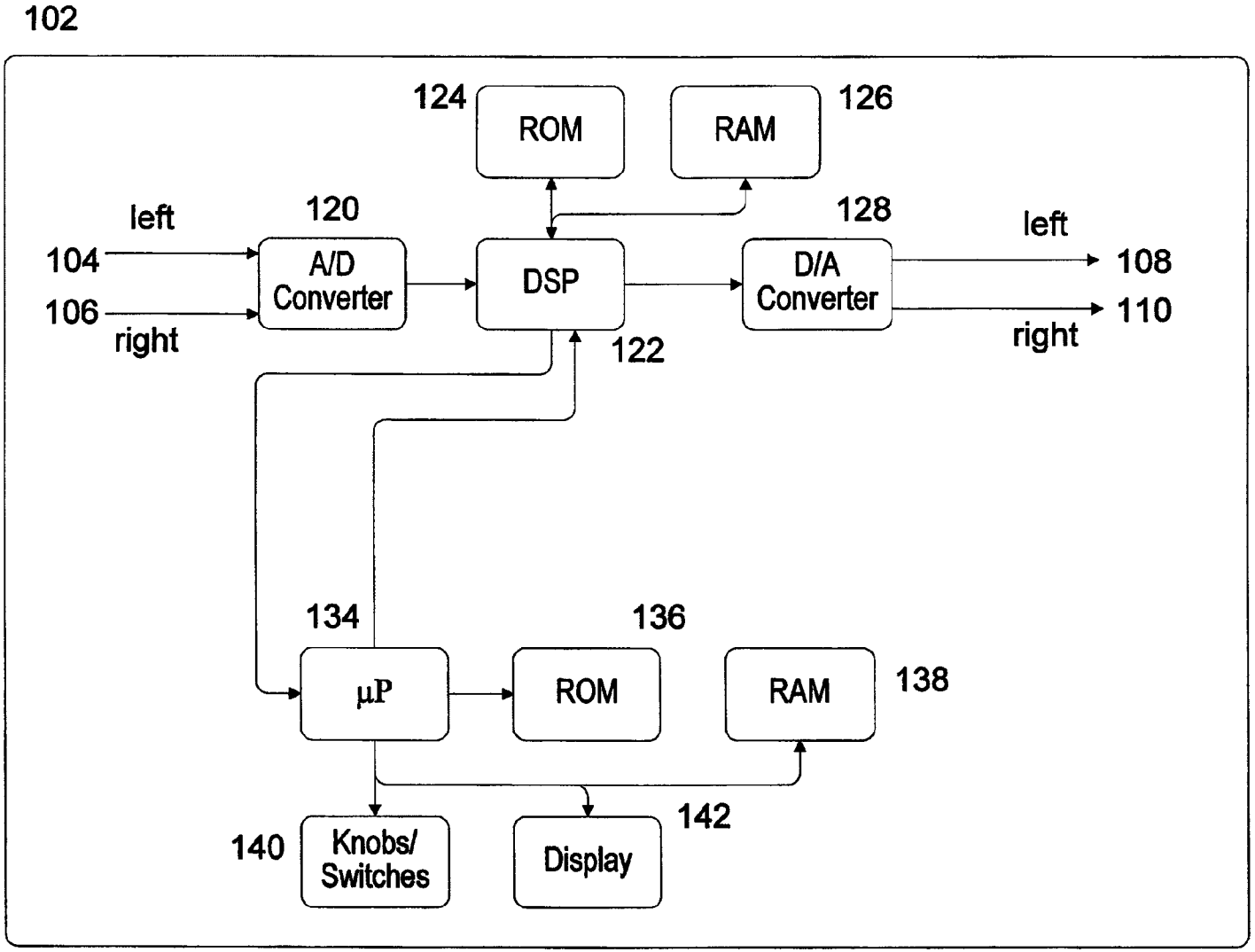
FIG. 1 is a block diagram of a representative guitar delay system.

As used in this application and in the claims, the singular forms "a," "an," and "the" include the plural forms unless the context clearly dictates otherwise. Additionally, the term "includes" means "comprises."

The systems, apparatus, and methods described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed systems, methods, and apparatus can be used in conjunction with other systems, methods, and apparatus. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

Theories of operation, scientific principles, or other theoretical descriptions presented herein in reference to the apparatus or methods of this disclosure have been provided for the purposes of better understanding and are not intended to be limiting in scope. The apparatus and methods in the appended claims are not limited to those apparatus and methods which function in the manner described by such theories of operation.

In a typical embodiment, a guitar delay engine such as a multi-tap delay pedal is provided. In other examples, rhythm engines such as vocal multi-tap delay pedals, drum machines, or other devices that provide a rhythmic pattern (i.e. level and timing information). Typical guitar delay devices are configured so that a guitarist can hold down a foot pedal, play a rhythmic pattern on a guitar, and then release the foot pedal so that the rhythmic pattern is emulated in the delay pattern provided by the guitar delay device.

In some examples, values, procedures, or apparatus' are referred to as "lowest", "best", "minimum," or the like. It will be appreciated that such descriptions are intended to indicate that a selection among many used functional alternatives can be made, and such selections need not be better, smaller, or otherwise preferable to other selections.

As used herein, an audio signal can be represented as an analog electrical signal (typically a time-varying voltage or current), a digitization of an analog signal, or an encoded version thereof. For example, audio signals can include analog signals after processing by an analog to digital convertor, or audio signals process for representation in an encoded format such as advanced audio coding (AAC) or mp3 format. Encoding can be lossless or lossy.

FIG. 1 is a block diagram of a representative guitar delay system (102). The input and output are shown as stereo signals with a left (104) and right (106) channel, but the system would work just as well with a single channel or with more than two channels. The input analog signals are passed through an analog to digital conversion block (120). In some embodiments, the input signal may already be in digital format and thus this step may be bypassed. The digital signals are then sent to a DSP (122) which stores the signals in random access memory (126). Read-only memory ROM (124) containing data and programming instructions is also connected to the DSP. The DSP block generates a stereo signal that is a mix of the input signal (i.e. the dry signal) and various delayed signals (i.e. the wet signal), where the delay time and level of the delayed signals are determined from the rhythm recognition system as disclosed below. The signals are converted to analog (if necessary) using digital to analog converters (D/A) (128), and sent to the output left (108) and right (110) channels. The microprocessor (134) is connected to ROM (136) containing program instructions and data, as well as RAM (138). It is also connected to the user interface components (displays, pointing devices, knobs, and switches) (140) and (142), and further connected to the DSP (122) in order to allow the user to interact with the rhythm generation system.

Figure 2:
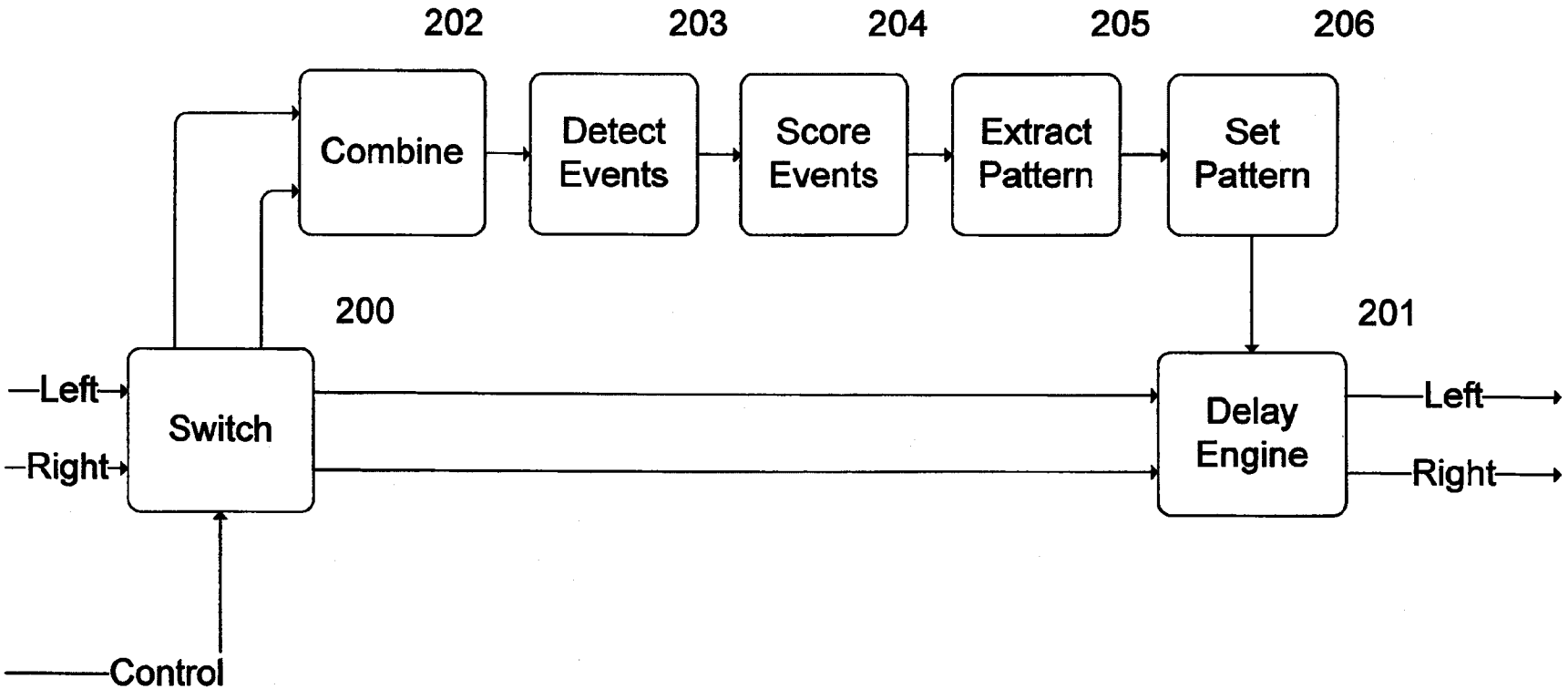
FIG. 2 illustrates a representative rhythm recognition system.

FIG. 2 shows a block diagram of the overall rhythm recognition system and a delay engine (201) as implemented in the digital signal processor. First, the stereo input is sent through the Switch Block (200) and routed either to the Delay Engine (201) or to the rhythm recognition engine based on a control signal that is typically controlled by the user stepping on a footswitch. When the input is routed to the rhythm recognition system, the stereo input is first processed by the Combine Block (202) to form a monophonic signal. The signals can be combined in various ways, but a simple averaging of the two signals was sufficient for the preferred embodiment. The monophonic signal is then processed by the Detect Events Block (203), which analyzes the audio to produce a list of events in the signal. Events are generally defined as rapid changes in signal energy and/or signal statistics. The Score Events Block (204) then assigns scores to each of the events, and the Extract Pattern Block (205) derives a rhythm pattern. A rhythm pattern consists of a set of beats and a repeat time (period). Each beat in the rhythm pattern has a delay time relative to the rhythm pattern start, and, optionally, a sound level. Finally the Set Pattern Block (206) sets the delay times and levels in the Delay Engine Block (201) according to the derived rhythm pattern. When the person releases the control signal footswitch attached to the Switch Block (200), the guitar signal will then flow through the Delay Engine Block (201) and the delay pattern extracted from the rhythm recognition system will be created.

Figure 3:
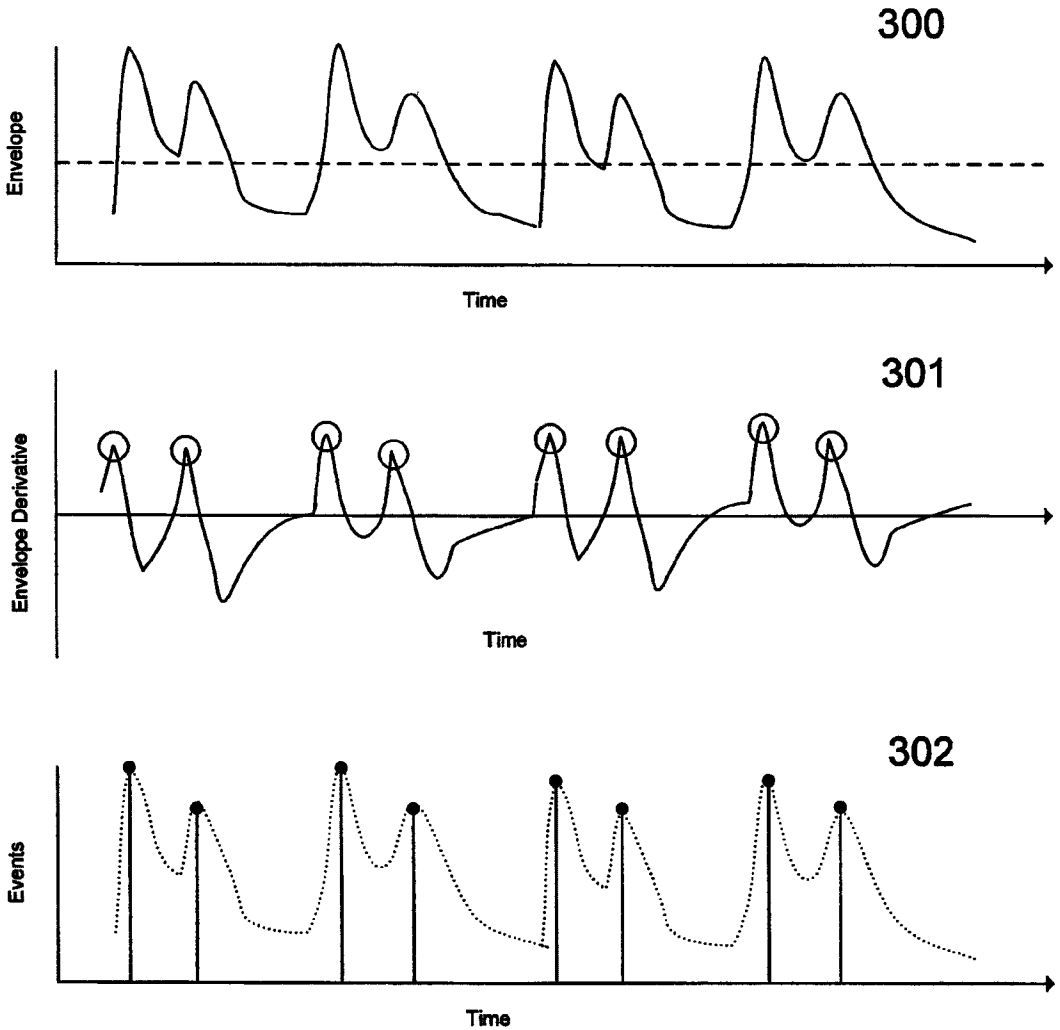
FIG. 3 illustrates representative audio signals used for event detection.
Figure 4:
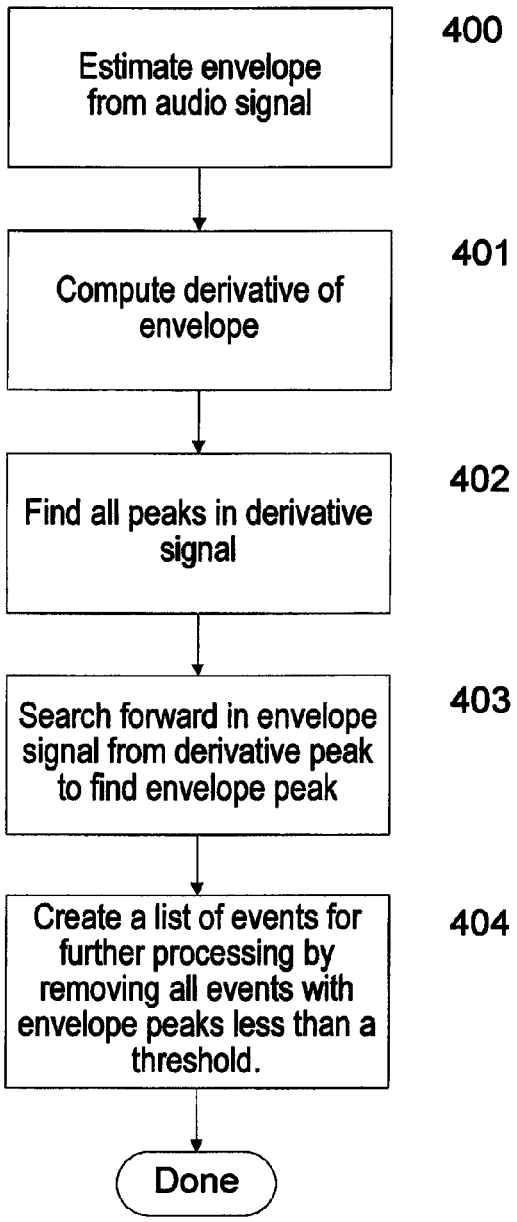
FIG. 4 is a block diagram of a method of event scoring and event detection.

FIG. 3 shows some hypothetical signals that are used for event detection, while FIG. 4 shows a flowchart of the logic used to detect events. Initially, the envelope of the audio signal is extracted (400) as illustrated in (300). There are many different envelope estimation techniques available, but a simple absolute value applied to the digital input samples followed by a low pass filter is sufficient. In the current system, a single pole digital filter was used with the following transfer function: $H(z)=1-a1/(1-a1/z)$ where $a1=0.98$. The derivative of the envelope is then computed (401) as illustrated in (301). The derivative is computed simply as a sample difference. That is, given that x[n] is the envelope signal, the derivative signal is given by x[n]−x[n−1]. All the derivative peaks are selected (402) as illustrated by the circles in (301). Notice that the peaks in the derivative signal correspond to the sharp rise just before the peaks in the envelope signal, and thus occur before the peak in the envelope signal. Therefore, the envelope signal must be searched forward (403) from the derivative peak to associate an envelope peak with each of the derivative peaks. Finally, a list of the resulting events is created for further processing (404) by retaining all events with envelope peaks greater than a minimum threshold (indicated by the dotted line in (302)). In a representative system, a value of 0.000316 (−70 dBfs) was used. An event consists of an envelope peak value (energy), an envelope derivative peak value (energy change), and a sample index which locates the event in time. The sample index for the event is the sample index at which the derivative peak was located. Note that the best method for determining events could vary depending on the type of input signals being processed. The method described here works well for guitar signals, but for other types of signals, it may be necessary to look for sudden changes in the signal statistics.

Events can be identified, extracted, and/or characterized based on one or more scores associated with portions or features of a digital audio signal. For example, scores can be associated with magnitudes of a signal, its derivatives, or other features of the signal including its spectrum and spectral envelope.

Figure 5:
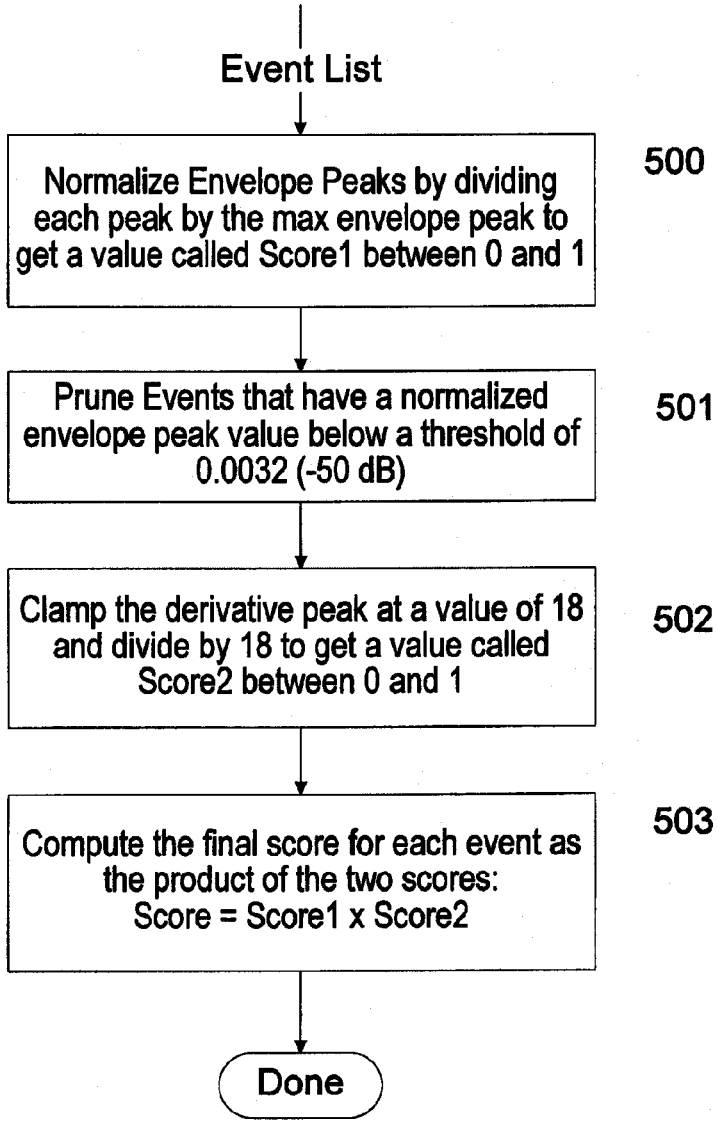
FIG. 5 is a block diagram of a representative method of event scoring.

FIG. 5 shows a flowchart of the logic used to create a score in a representative system for each event in the event list. First, the envelope peak values are normalized (500) by dividing each peak value by the value of the maximum envelope peak in the list to obtain a value, Score1 which is between 0 and 1 Next, any events that have a Score1 value below a threshold are discarded (501). In a representative system, this threshold is set to 0.0032 (−50 dBfs). Next, the envelope derivative peak values are clamped (we used a clamp value of 18) and divided by this clamped value in order to obtain a value, Score2, which is between 0 and 1 (502). Finally, the final score for each event is computed as a value between 0 and 1 by multiplying Score1 by Score2. The result is a list of events that will be used for pattern extraction.

Figure 6:
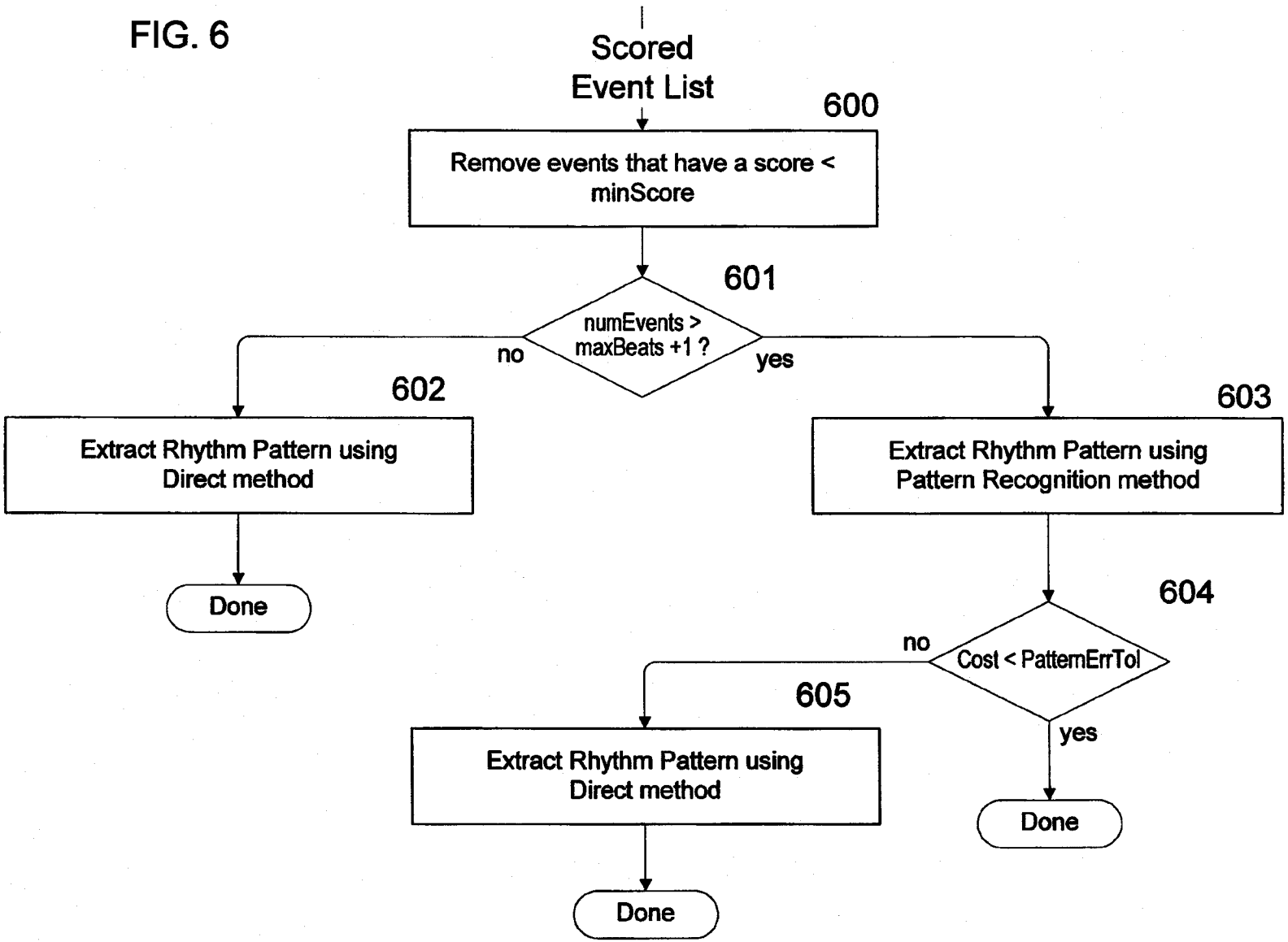
FIG. 6 is a block diagram of a representative method of extracting rhythm patterns.

FIG. 6 shows a flowchart giving an overview of the logic used to extract patterns from the event list. First, any events that have a score <minScore are considered to be unimportant and are pruned from the event list. In a representative system we use a value of 0.08 for the value of minScore.

Next, the number of events in the pruned list is counted (601). If that number is less than maxBeats+1, then it is assumed that the pattern was entered by the user only once, and therefore a direct method to compute the pattern is used. Note that the criterion for using the direct method could also be controlled by a user parameter or some other mechanism. In one example system, maxBeats is set to 6. The direct method (602) assumes that the first N+1 strums define the N beats of the pattern, and works by computing the difference between the sample index of each event and the sample index of the first event. The pattern repeat period is set to be equal to the last event for which this difference is less than Pmax (the maximum period in samples for a pattern—in one example system this corresponds to 5 s), and this event is labeled E_N+1. For each event starting with the $2^{nd}$ event (E_2) and ending with E_N+1, we add a new beat, to the pattern and set the delay time for B_i to the difference between the corresponding event sample index and the first event sample index. The level for B_i is set to the envelope peak value for E_i+1.

Figure 7:
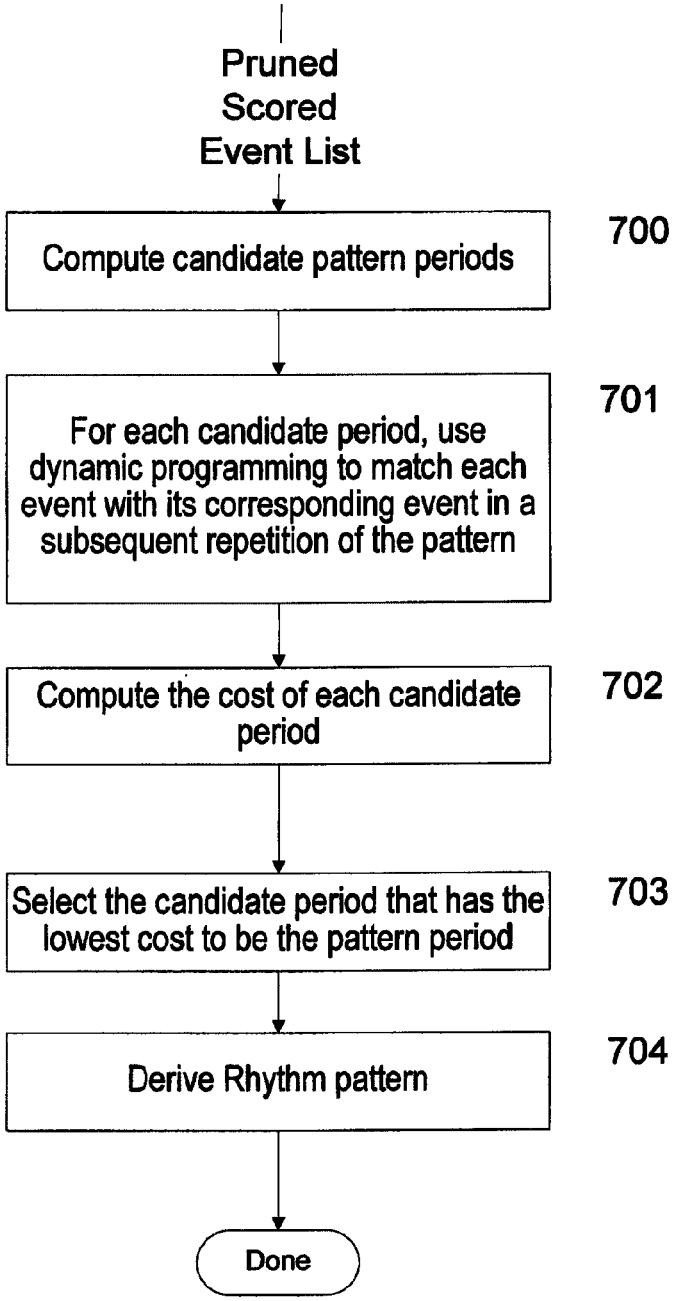
FIG. 7 is a block diagram of a representative method of rhythm pattern recognition.

If the number of events in the pruned list is greater than maxBeats+1, the pattern is extracted using the pattern recognition method under the assumption that it was repeated by the user two or more times (603). The pattern recognition flow chart is shown in FIG. 7. First, a candidate set of periods are computed for the pattern (700). The candidate periods are defined by subtracting the index sample of each event, starting with the $2^{nd}$ event, from the index sample of the first event.

Next, for each candidate period, an attempt is made to match each event with its corresponding event in a subsequent repetition of the pattern. If the input, for example, consists of 6 events in which the first 3 events define the first repetition of the pattern and the second 3 events define the second iteration of the pattern, then event 1 would be matched with event 4, event 2 would be matched with event 5, and event 3 would be matched with event 6. However, due to fact that for this system to be useful it must be robust to the various sources of error in entering the pattern, for example errors in timing, missing beats, extra erroneous beats that made it through the initial pruning process, a method has been developed based on dynamic programming to create an optimal set of event matches based on minimizing a cost function.

First, a path is defined as a set of event pairings for each event. The first event in a pairing is the source event, and the second event in a pairing is the target event. Note that not every event necessarily will be a source event or a target event. For example, some events will be considered erroneous and will not be matched with any other peaks. Other events may be target events, but may also be in the last pattern repetition and therefore they will not be source events.

Next, a cost function is defined as follows: C(E_i,E_j)=min (MaxCost, |ndx_i+Pc−ndx_j|)+SourceSkipPenalty+TargetSkipPenalty where:

- E_i is the $i^{th}$ event,
- MaxCost is the maximum cost that can be incurred due to an event timing error (set to 400 ms in one example system)
- ndx_i is the sample index for event E_i
- Pc is the candidate period
- SourceSkipPenalty is a penalty given if this match causes a source event to be unmatched (set to 300 ms in one example system)
- TargetSkipPenalty is the penalty given if this match causes a target event to be unmatched (set to 200 ms in one example system).

The dynamic programming algorithm (701) proceeds as follows:

- Match the first event with the event that is one candidate period away. Note that the cost of this match will always be zero because the candidate period was chosen based on this pairing. This defines the anchor for all candidate paths.
- Match the 2nd event with each subsequent event. This set of N matches results in N candidate paths.
- Choose the M best paths from the N candidate paths (in one example, M=2) which are the paths that have the lowest cost.
- For each of the M best paths, match the next event with each subsequent event, and repeat the previous step.
- When there are no more subsequent events, there will be M candidate paths. The path with the lowest total cost is then chosen as the best path for this particular candidate period.

The cost for each candidate period is computed as follows: First, the candidate period is refined by computing the average distance between each matched peak. The cost function for each pair is also refined by re-computing the cost with the new candidate period. Finally, a total cost for each candidate period is compute (702) by compute the sum of the squared costs for each pair, and dividing that by the number of events that were selected as source events.

Once the best path for each candidate period is computed, the candidate with the lowest associated cost is selected (703).

Now that there are a set of optimal matched events, the next step is to derive the rhythm pattern delays and levels (704). This is not necessarily straightforward because the dynamic programming algorithm for peak assignment allows the flexibility of having one or more peaks missing from one or more of the pattern repetitions. The algorithm for defining the rhythm pattern proceeds as follows:

- Start with the first source event and compute the distance to the next source event by finding the difference between the event sample times. Then, find the target of the first event and compute the distance to its next event. Continue until there are no more events left. The set of distances are averaged to get the delay time of the first beat. The energies associated with each event are also averaged to get the level of the first beat. Note that whenever an event pair has been used to compute a delay, it is marked as "done."
- Next, compute the distance between the first source event and the third source event. Using the same method as above, obtain an averaged delay time and averaged level for the 2nd beat.
- Continue with each source event whose source/target pair has not been marked "done."
- When this step is completed, we have a set of beats for the rhythm pattern. Note that if an event was missing, this method will produce beats with delay times that are not monotonically increasing. Therefore the beats need to be sorted according to increasing delay times.

At this point, a final check is done to see if the cost associated with the pattern derived using the pattern recognition method is less than a threshold (PatternErrTol, which in one example system is set to 0.05). If that is the case, the error in using the complex pattern is considered to be too high, and instead the direct method described above is used to compute the rhythm pattern.

Note that there are two other steps that can be used to restrict the patterns in order to make them more musical as well as more robust to human error:

- The levels and times may be quantized if necessary to restrict the rhythm pattern to a specific musical template.
- An integer sub-multiple of the chosen period may be used if the cost associated with that period is close enough to the period with the minimum cost. This reduces the chance of combining an integer number of repeats of the pattern into a single repetition due to slight timing errors.

Once the rhythm pattern has been determined, the delay times and levels for each tap in the delay engine are set to match each beat in the rhythm pattern. In the stereo setup used for the delay engine, taps can be set to have the same value on the left and right channel (i.e. center pan), or the taps could be set to alternate left and right based on a system or user preference. It should be clear that the taps may be assigned to the left and right channels using alternate criteria and/or parameters.

A delay engine can be implemented in a variety of ways. The description below defines a typical delay engine, but the exact implementation is not critical to the claims of this invention. The delay engine uses a circular buffer to implement the delay effect. A circular buffer is a signal processing construct that writes audio into a fixed size buffer at a location defined by the write pointer in a circular manner such that when the buffer is full, the write pointer wraps back to the start of the buffer. There is also one or more read pointers that read audio out of the circular buffer at a specified delay from the write pointer. The read pointer also wraps at the boundaries of the circular buffer such that audio is always read from a valid location in the fixed size audio buffer. The audio read out of the circular buffers may optionally be written back into the circular buffer at the position of the write pointer with a user or system defined gain to produce a feedback loop. There is also a user or system defined output gain associated with each read pointer such that the audio from each read pointer is multiplied by said output gain and mixed together to form the wet delay signal. The wet delay signal is then multiplied by an overall wet gain before being mixed with the dry (i.e. the input) signal to produce the output of the delay engine. In the present invention, the output gain and delay associated with each read pointer is set using the rhythm pattern extraction as described above.

This section describes various examples of methods and apparatus embodying the disclosed technology. The following descriptions include the step of setting level information from the derived rhythm pattern, however it should be noted that setting level information is an enhancement and not necessary to create useful rhythm information for the output rhythm engine.

The first example is a method where an audio signal is analyzed to extract timing and level information of events for use in a rhythm engine. To accomplish this, the method would locate the events in audio signal, compute the level and timing of these events, determine the most likely rhythm pattern from the level and timing information, and finally set the timing and level information of the determined pattern in a rhythm engine.

Typical input signals include electric guitar signals or acoustic guitar signals (from a mic or a pickup). Vocal signals and other acoustic signals can also be used as the input signal where the vocal signal or other acoustic signal is picked up using a microphone.

One example of a typical rhythm engine is a delay engine in which the input is played back at a delay time related to the timing information of the rhythm pattern, and at a level related to the level information of the rhythm pattern. Another example is a synthesizer or music generation system in which a different signal from the input is played back one or more times in sequence where the playback times are related to the timing information of the derived rhythm pattern and the playback levels are related to the level information of the derived pattern.

One specific embodiment of this invention is a guitar delay pedal in which an electric guitar is plugged into the pedal as an input. An analog to digital converter is used to convert the input signal into a digital signal. The rhythm pattern recognition system is implemented as machine code that runs on a DSP. When the user depresses a switch, for example on a foot pedal, the DSP analyzes the input signal and detects the rhythm pattern that the user is playing according to the described invention. When the player releases the pedal, the delays are configured according to the rhythm pattern. Another switch or foot pedal could be used to enable or disable the delay effect. Another specific embodiment of this invention is a drum machine that derives the rhythm pattern in the same way as the guitar delay pedal, but instead of setting delay times and levels, the drum machine creates a drum pattern with various drum sounds corresponding to the recognized beats. The drum pattern would be repeated, resulting in a drum pattern that matched the rhythm specified by the user. Different types of drum sounds could be selected using, for example, a knob on the user interface.

It should be noted that the automatic rhythm recognition system could be implemented entirely in software as machine code, and could be used in the form of a computer program that can run on a general purpose computer. The computer program could be a stand-alone application or a software plug-in that runs within the environment of another computer program. In these cases, the rhythm recognition system could work on input signals that are stored on disk or other computer media. The output of the system could be the creation of an output audio file, or, for example, control information such as MIDI information containing the timing and level information of the derived rhythm pattern.

Figure 8:
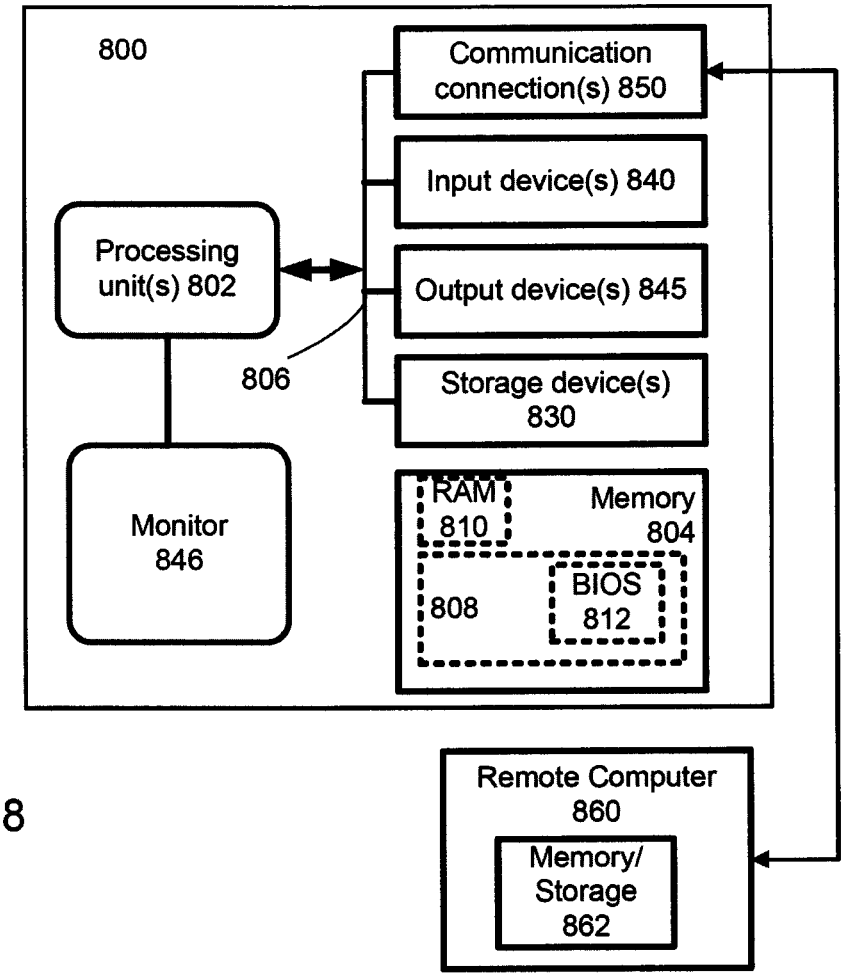
FIG. 8 is a block diagram of a representative computing environment.

FIG. 8 and the following discussion are intended to provide a brief, general description of an exemplary computing environment in which the disclosed technology may be implemented. Although not required, the disclosed technology is described in the general context of computer-executable instructions, such as program modules, being executed by a personal computer (PC). Generally, program modules include routines, programs, objects, components, data structures, etc., that perform particular tasks or implement particular abstract data types. Moreover, the disclosed technology may be implemented with other computer system configurations, including hand-held devices, multiprocessor systems, microprocessor-based or programmable consumer electronics, network PCs, minicomputers, mainframe computers, and the like. The disclosed technology may also be practiced in distributed computing environments where tasks are performed by remote processing devices that are linked through a communications network. In a distributed computing environment, program modules may be located in both local and remote memory storage devices.

With reference to FIG. 8, an exemplary system for implementing the disclosed technology includes a general purpose computing device in the form of an exemplary conventional PC 800, including one or more processing units 802, a system memory 804, and a system bus 806 that couples various system components including the system memory 804 to the one or more processing units 802. The system bus 806 may be any of several types of bus structures including a memory bus or memory controller, a peripheral bus, and a local bus using any of a variety of bus architectures. The exemplary system memory 804 includes read only memory (ROM) 808 and random access memory (RAM) 810. A basic input/output system (BIOS) 812, containing the basic routines that help with the transfer of information between elements within the PC 800, is stored in ROM 808.

The exemplary PC 800 further includes one or more storage devices 830 such as a hard disk drive for reading from and writing to a hard disk, a magnetic disk drive for reading from or writing to a removable magnetic disk, and an optical disk drive for reading from or writing to a removable optical disk (such as a CD-ROM or other optical media). Such storage devices can be connected to the system bus 806 by a hard disk drive interface, a magnetic disk drive interface, and an optical drive interface, respectively. The drives and their associated computer-readable media provide nonvolatile storage of computer-readable instructions, data structures, program modules, and other data for the PC 800. Other types of computer-readable media which can store data that is accessible by a PC, such as magnetic cassettes, flash memory cards, digital video disks, CDs, DVDs, RAMs, ROMs, and the like, may also be used in the exemplary operating environment.

A number of program modules may be stored in the storage devices 830 including an operating system, one or more application programs, other program modules, and program data. A user may enter commands and information into the PC 800 through one or more input devices 840 such as a keyboard and a pointing device such as a mouse. Other input devices may include a digital camera, microphone, joystick, game pad, satellite dish, scanner, or the like. These and other input devices are often connected to the one or more processing units 802 through a serial port interface that is coupled to the system bus 806, but may be connected by other interfaces such as a parallel port, game port, or universal serial bus (USB). A monitor 846 or other type of display device is also connected to the system bus 806 via an interface, such as a video adapter. Other peripheral output devices, such as speakers and printers (not shown), may be included.

The PC 800 may operate in a networked environment using logical connections to one or more remote computers, such as a remote computer 860. In some examples, one or more network or communication connections 850 are included. The remote computer 860 may be another PC, a server, a router, a network PC, or a peer device or other common network node, and typically includes many or all of the elements described above relative to the PC 800, although only a memory storage device 862 has been illustrated in FIG. 8. The personal computer 800 and/or the remote computer 860 can be connected to a logical a local area network (LAN) and a wide area network (WAN). Such networking environments are commonplace in offices, enterprise-wide computer networks, intranets, and the Internet.

When used in a LAN networking environment, the PC 800 is connected to the LAN through a network interface. When used in a WAN networking environment, the PC 800 typically includes a modem or other means for establishing communications over the WAN, such as the Internet. In a networked environment, program modules depicted relative to the personal computer 800, or portions thereof, may be stored in the remote memory storage device or other locations on the LAN or WAN. The network connections shown are exemplary, and other means of establishing a communications link between the computers may be used.

In view of the many possible embodiments to which the principles of the disclosed technology may be applied, it should be recognized that the illustrated embodiments are only preferred examples and should not be taken as limiting in scope.

We claim:

1. A method, comprising:
receiving a digital audio signal from a musical instrument;
analyzing the received digital audio signal to detect events in the digital audio signal;
selecting events from the detected events based on a score associated with the events;
extracting a rhythmic pattern based on the selected events; and
generating an acoustic signal based on the extracted rhythmic pattern so as to accompany an acoustic signal from the musical instrument.

2. The method according to claim 1, wherein the extracted rhythmic pattern includes a pattern period and beat time locations within the rhythmic pattern.

3. The method of claim 2, wherein the extracted rhythmic pattern includes beat levels.

4. The method of claim 1, wherein events are detected based on energy in the digital audio signal in at least one frequency band.

5. The method of claim 1, wherein the event detection includes scoring events based on at least one of a derivative peak level and an envelope peak level, and pruning events with scores less than a minimum allowable score.

6. The method of claim 1, wherein the rhythmic pattern is extracted by locating at least one pattern period repetition.

7. The method of claim 1, wherein the beat locations and levels of the rhythmic pattern are based on the event locations and levels extracted based on the rhythm pattern period.

8. The method of claim 1, wherein the musical instrument is a stringed instrument.

9. The method of claim 8, wherein the musical instrument is a guitar.

10. The method of claim 1, further comprising communicating the rhythmic pattern to a delay effect processor, a drum machine, or a sequencer.

11. A method for determining rhythms, comprising:
receiving a digital audio signal from a musical instrument;
analyzing the received digital audio signal to detect events in the digital audio signal;
selecting events from the detected events based on a score associated with the events;
extracting a rhythmic pattern based on the selected events; and
communicating the rhythmic pattern, wherein events are detected by:
estimating an energy envelope of the received digital audio signal in one or more frequency bands;
estimating a derivative of the energy envelope in one or more frequency bands;
identifying at least two peaks in the derivative; and
associating the at least two peaks with corresponding events, wherein timing information is extracted based on times associated with the peaks.

12. The method of claim 11, further comprising establishing an event time and level by searching forward in the energy envelope from at least one derivative peak.

13. A method for determining rhythms, comprising:
receiving a digital audio signal from a musical instrument;
analyzing the received digital audio signal to detect events in the digital audio signal;
selecting events from the detected events based on a score associated with the events;
extracting a rhythmic pattern based on the selected events, wherein the extracted rhythmic pattern includes at least one pattern period and beat time location within the rhythmic pattern and the rhythmic pattern is extracted by locating at least one pattern period repetition, wherein the at least one pattern period repetition is located by:
grouping events into candidate repeating periods;
matching events between the repeating periods;
establishing a cost for each set of matched events based on a temporal distance between the matching events;
increasing the cost for each set of matched events based on a number of events that are unmatched between the repeating periods;
determining overall costs based on the established costs and the increased costs; and
selecting at least one repeating pattern based on the determined costs.

14. The method of claim 13, wherein the pattern analyzer uses dynamic programming to search for the period associated with optimal event matching.

15. At least one computer readable storage medium having computer-executable instructions for a method comprising:
analyzing a received digital audio signal from a musical instrument to detect events in the digital audio signal;
selecting events from the detected events based on scores associated with the events; and
extracting a rhythmic pattern based on the selected events; and
generating a rhythmic acoustic signal based on the extracted rhythm pattern so as to accompany an acoustic signal from the musical instrument.

16. The computer readable storage medium of claim 15, wherein the method further comprises storing the rhythmic pattern in a memory.

17. An apparatus, comprising:
an input configured to receive a digital audio signal from a musical instrument;
a processor configured to
analyze the received digital audio signal to detect events in the digital audio signal,
select events from the detected events based on scores associated with the events, and
extract a rhythmic pattern based on the selected events; and
an output configured to deliver the rhythmic pattern so as to produce an accompaniment acoustic signal based on the extracted rhythmic pattern.

18. The apparatus of claim 17, wherein the processor is configured to extract the rhythmic pattern by locating at least one pattern period repetition.

19. The apparatus of claim 17, wherein the extracted rhythmic pattern includes beat levels.

20. An apparatus, comprising:
an input configured to receive a digital audio signal from a musical instrument;
a processor configured to
analyze the received digital audio signal to detect events in the digital audio signal,
select events from the detected events based on scores associated with the events, and
extract a rhythmic pattern based on the selected events; and
an output configured to deliver the rhythmic pattern, wherein the processor is configured to search for a repeating pattern by:
grouping events into candidate repeating periods;
matching events between the repeating periods;
establishing a cost for each set of matched events based on a temporal distance between the matching events;

increasing the cost for each set of matched events based on a number of events that are unmatched between the repeating periods;

determining overall costs based on the established costs and the increased costs; and selecting at least one repeating pattern based on the determined costs.

21. An apparatus, comprising:

an input configured to receive a digital audio signal from a musical instrument;

a processor configured to:

analyze the received digital audio signal to detect events in the digital audio signal, select events from the detected events based on scores associated with the events, and extract a rhythmic pattern based on the selected events; wherein the processor is configured to detect events by:

estimating an energy envelope of the received digital audio signal in one or more frequency bands;

estimating a derivative of the energy envelope in one or more frequency bands;

identifying at least two peaks in the derivative; and associating the at least two peaks with corresponding events, wherein timing information is extracted based on times associated with the peaks; and an output configured to deliver the rhythmic pattern.

22. A method, comprising:

receiving a digital audio signal associated with a musical instrument;

analyzing the received digital audio signal to detect events in the digital audio signal;

selecting events from the detected events based on a score associated with the events;

extracting a rhythmic pattern based on the selected events; and generating an acoustic signal based on the extracted rhythmic pattern and a second audio signal from the musical instrument.

23. The method of claim 22, wherein the acoustic signal is generated based on a delay pattern associated with the extracted rhythmic pattern.

24. The method of claim 23, further comprising initiating the analyzing of the digital audio signal in response to a control signal from a footswitch.

25. At least one computer-readable medium having stored therein computer-executable instructions for the method of claim 22.

26. An apparatus, comprising:

a processor configured to:

analyze a first digital audio signal from a musical instrument to detect events in the digital audio signal, select events from the detected events based on scores associated with the events, extract a rhythmic pattern based on the selected events, and apply a delay pattern based on the extracted rhythmic pattern to a second audio signal from the musical instrument.

27. The apparatus of claim 26, wherein the processor is configured to extract the rhythmic pattern by locating at least one pattern period repetition.

28. The apparatus of claim 27, wherein the processor is configured to search for a repeating pattern by:

grouping events into candidate repeating periods;

matching events between the repeating periods;

establishing a cost for each set of matched events based on a temporal distance between the matching events;

increasing the cost for each set of matched events based on a number of events that are unmatched between the repeating periods;

determining overall costs based on the established costs and the increased costs; and selecting at least one repeating pattern based on the determined costs.

29. The apparatus of claim 26, wherein the extracted rhythmic pattern includes beat levels.

* * * * *